US007553554B2

(12) United States Patent
Miller et al.

(10) Patent No.: US 7,553,554 B2
(45) Date of Patent: Jun. 30, 2009

(54) ENVIRONMENTALLY PROTECTED REINFORCEMENT DOWEL PINS AND METHOD OF MAKING

(75) Inventors: Wes Miller, Kingsport, TN (US); Christopher P. Schenk, Glen Ellyn, IL (US); Derek Tarrant, Greeneville, TN (US)

(73) Assignee: Jarden Zinc Products, LLC, Greenville, TN (US)

( * ) Notice: Subject to any disclaimer, the term of this patent is extended or adjusted under 35 U.S.C. 154(b) by 0 days.

(21) Appl. No.: 11/443,907

(22) Filed: May 31, 2006

(65) Prior Publication Data

US 2006/0257231 A1 Nov. 16, 2006

Related U.S. Application Data

(63) Continuation of application No. 10/855,536, filed on May 27, 2004, now abandoned.

(51) Int. Cl.
*E04C 5/01* (2006.01)
*E04C 5/03* (2006.01)

(52) U.S. Cl. ..... 428/659; 411/902; 52/396.02

(58) Field of Classification Search ..... 411/427, 411/900–902; 404/47, 52; 52/396.02
See application file for complete search history.

(56) References Cited

U.S. PATENT DOCUMENTS 990,443 A 4/1911 Lohmann
2,093,697 A * 9/1937 Scholer ..... 404/62
2,244,337 A 6/1941 Isett
2,448,134 A 8/1948 Abel
3,884,116 A 5/1975 Hage
4,516,876 A 5/1985 Wicks
4,781,508 A 11/1988 Schroeder et al.
4,990,231 A 2/1991 Stewart et al.
5,183,694 A 2/1993 Webb (Continued)

FOREIGN PATENT DOCUMENTS

EP 0117710 9/1984

(Continued)

OTHER PUBLICATIONS

The Delphion Integrated View, JP63051111A2: Mold, Thomson Delphion, Assignee: Nissei Plastics Ind Co., Published Mar. 4, 1988, JP1986000196325 in Japan.

(Continued)

*Primary Examiner*—Jack W. Lavinder
(74) *Attorney, Agent, or Firm*—Lawrence J. Shurupoff

(57) ABSTRACT

Galvanically protected reinforcement dowel pins and methods of producing the same. In one embodiment, the reinforcement dowel pins comprise a bar or tube, the longitudinal exposed surfaces of which are covered by a heavy gauge of a sacrificial metal, such as zinc, zinc alloy, magnesium, magnesium alloy, aluminum, or aluminum alloy. The bar or tube comprises steel, carbon steel, or other ferrous metal. The heavy gauge of sacrificial metal is applied to the ferrous metal by various processes, such as roll bonding, lock seaming, welding, die casting, flame spraying, plasma spraying, dipping, sinking, and drawing. The resulting reinforcement dowel pins resist corrosion without sacrificing structural integrity, and are reasonable in materials and manufacturing costs. These dowel pins may be installed in adjacent concrete panels using conventional methods, and therefore do not introduce additional costs in installation.

14 Claims, 2 Drawing Sheets

U.S. PATENT DOCUMENTS

| | | | | |
|---|---|---|---|---|
| 5,190,395 | A | 3/1993 | Cathey et al. | |
| 5,201,467 | A | 4/1993 | Kennel et al. | |
| 5,353,868 | A | 10/1994 | Abbott | |
| 5,371,990 | A | 12/1994 | SalahUddin | |
| 5,564,876 | A | 10/1996 | Lat | |
| 5,616,424 | A | 4/1997 | Carey, II et al. | |
| 5,697,196 | A | 12/1997 | SalahUddin | |
| 5,704,180 | A | 1/1998 | Boeck | |
| 5,714,045 | A | 2/1998 | Lasa et al. | |
| 5,985,365 | A | 11/1999 | Jaye | |
| 6,010,291 | A | 1/2000 | Schwingle | |
| 6,039,503 | A | 3/2000 | Cathey | |
| 6,079,972 | A | 6/2000 | Gellert | |
| 6,095,739 | A | 8/2000 | Albertson et al. | |
| 6,276,400 | B1 * | 8/2001 | Jackson et al. | 138/143 |
| 6,503,024 | B2 | 1/2003 | Rupiper | |
| 6,508,926 | B1 | 1/2003 | Falkner et al. | |
| 6,575,723 | B2 | 6/2003 | Ondrejka | |
| 6,681,838 | B2 | 1/2004 | Cui et al. | |
| 6,898,912 | B2 | 5/2005 | Bravinski | |
| 6,931,806 | B2 | 8/2005 | Olsen | |
| 2003/0170093 | A1 | 9/2003 | Janeway | |
| 2003/0192272 | A1 | 10/2003 | Bravinski | |
| 2005/0115195 | A1 * | 6/2005 | Bettigole et al. | 52/782.1 |

FOREIGN PATENT DOCUMENTS

| | | | |
|---|---|---|---|
| EP | 0684119 | A2 | 11/1995 |
| WO | WO 02/22341 | A1 | 3/2002 |

OTHER PUBLICATIONS

The Delphion Integrated View, JP63281817A2: Injection Mold Assembly, Thomson Delphion; Assignee: Matsushita Electric Ind Co Ltd., Published Nov. 18, 1988 in Japan.

The Delphion Integrated View,JP1159230A2: Two-Layer Hollow Molding Method Making Use of Single Layer Molding Machine and Its Device, Thomson Delphion, Assignee: Chiyoda Seisakusho:kk, Published Jun. 22, 1989, JP1987000319694 in Japan.

The Delphion Integrated View,JP2003053763A2: Mold Assembly for Expansion Molding and Expansion-Molding Method, Thomson Delphion, Assignee: Daisen Kogyo:kk, Published Feb. 26, 2003, JP2001000244315 in Japan.

The Delphion Integrated View,JP20032224941A2: Roll Bond Panel, Thomson Delphion, Assignee: Hitachi Cable Ltd, Published Aug. 8, 2003, JP2002000021094 in Japan.

The Delphion Integrated View,JP2000039274A2: Sealing Method for Roll Bond Heat Pipe, Thomson Delphion, Assignee: Showa Alum Corp, Published Feb. 8, 2000, JP1998000208149 in Japan.

The Delphion Integrated View (Inpadoc Record),RU2163959C2: Joint of Concrete Structural Components, Thomson Delphion, Assignee: Zikon S.R.O., Published Mar. 20, 2001, RU1996097118337 in Russian Federation.

Stainless Steel Clad Dowels—The New Standard for Corrosion Resistant Load Transfer Dowels.

Definition of "nail", Webster's II New College Dictionary, Copyright 2001, p. 726.

American Galvanizers Association, "about galvanizing: HDG process", http://www.galvanizeit.org/showContent,42,74.cfm.

American Galvanizers Association, "Service Life Chart for Hot-Dip Galvanized Coatings", http://www.galvanizeit.org/resouces/files/AGA_root/pdf_files/pubs/PR-SLC-05.pdf.

* cited by examiner

ENVIRONMENTALLY PROTECTED REINFORCEMENT DOWEL PINS AND METHOD OF MAKING

CROSS-REFERENCE TO RELATED APPLICATIONS

This application is a continuation of application Ser. No. 10/855,536, filed May 27, 2004 now abandoned.

BACKGROUND OF THE INVENTION

This invention relates to reinforcement dowel pins, and, in particular, to reinforcement dowel pins used in concrete surface construction, and methods of making the same.

Concrete highways and other concrete surfaces are often built in sections. Such sections are useful in controlling and addressing thermal expansion of the concrete surface and avoidance of the problems, such as cracking, that can occur when thermal expansion is not controlled. To accommodate for thermal expansion, joints are usually placed between adjacent panels to allow movement in the direction of the roadway between panels while maintaining the correct lateral and vertical locations of each panel to keep the road surface level and in place.

Various types of construction have been used for "joining" these adjacent panels. These methods include the use of:

1. Solid or tubular steel dowel pins;
2. Epoxy coated solid or tubular steel dowel pins;
3. Glass fiber reinforced composite dowel pins; or
4. Stainless steel solid or tubular steel dowel pins.

Solid steel or tubular steel dowel pins, the most commonly used types of dowel pins, corrode rapidly, particularly in an environment were de-icing salts are used to treat the highway. Epoxy coated dowel pins are initially better than uncoated dowel pins in protecting against corrosion; however, the welding of these dowel pins into support structures during road construction and the abrasion resulting from slab (adjacent panel) movement after construction ultimately wear away the epoxy coating and exposes the steel surface. Once the steel surface of the dowel pin is exposed, corrosion becomes an issue, just as with uncoated dowel pins. Glass fiber reinforced composite pins are weaker and more expensive than steel dowel pins, and stainless steel dowel pins are effective, but very expensive.

Some prior art systems have been developed that are directed toward reduction of the corrosion of steel dowel pins. These systems include that of U.S. Pat. No. 2,093,697. The invention of U.S. Pat. No. 2,093,697 provides a joint form for placement between the slabs. The joint form forms a trough pocket for holding a sealing material. The system of U.S. Pat. No. 2,093,697 requires that additional materials, other than the dowel pins, must be installed between the adjacent sections, and is therefore expensive to implement and to install. U.S. Pat. No. 5,183,694 discloses a system that uses electrodes electrically connected to the reinforcement rods. Again, additional materials must be procured, brought to the installation site, and installed, and additional steps are required for installation of this system. Thus, like the system of U.S. Pat. No. 2,093,697, the system of U.S. Pat. No. 5,183,694 is expensive to implement and install.

Thus, it is desired to provide reinforcing dowel pins, such as those used in highway construction or in other concrete surfaces comprising at least two sections, that resist corrosion, without being detrimental to the strength of the dowel pins when compared to the strength of steel dowel pins, and without significantly increasing the cost of the dowel pins. It is also desired to provide a system for joining adjacent sections of concrete that does not require that materials other than the dowel pins be procured, and does not require additional installation steps, to thereby minimize the costs of such a system.

SUMMARY

The present invention comprises environmentally protected reinforcement dowel pins, and methods of making the same. In one embodiment, the dowel pins are comprised of steel or carbon steel, or other ferrous metal and are of the type used for reinforcement in highway construction or construction of other concrete surfaces, such as between adjacent concrete panels. Generally, the reinforcement dowel pins of the present invention comprise a bar or tube of steel, carbon steel, or other ferrous metal together with a metal that serves as a sacrificial anode with respect to the ferrous metal. The applied metal, such as zinc, zinc alloy, magnesium, magnesium alloy, aluminum, or aluminum alloy is applied in heavy gauge over the exterior surface of the bar or tube. The metal is applied in such a manner that it is in intimate contact with the longitudinal exposed surfaces of the bar or tube. In the case of a tube, the metal may be applied to one or both of the interior and exterior exposed surfaces of the tube. Once applied, the applied metal of this embodiment functions as a sacrificial anode and provides galvanic protection to the bar or tube.

Methods used for the application of the sacrificial anodic metal to the bar or tube of the dowel pin comprise roll forming, die casting, coating, sinking, drawing, welding, and lock seaming. According to one method of the present invention, a heavy gauge zinc, zinc alloy, magnesium, magnesium alloy, aluminum, or aluminum alloy tube is placed on the exterior surfaces of the bar or tube. Then, the heavy gauge tube is drawn down onto the exterior surface of the bar or tube by the sink-draw process to cause the heavy gauge sacrificial anode metallic tube to be in intimate contact with the exposed, exterior longitudinal surface(s) of the bar or tube.

In the case of a tubular dowel pin, an optional, small diameter metal tube may be placed inside the tube of the dowel pin and expanded outward using the sink-draw process to bring the inner metal tube into intimate contact with the interior surface of the tubular pin. Alternately, for a tubular dowel pin, another method involves a steel, carbon steel, or other ferrous metal strip that is clad (roll bonded) on one or both sides with a galvanic metal (zinc, magnesium, aluminum, or their alloys as above) that is formed into dowel tubes and welded or lock seamed into a tubular shape as necessary. This comprises one of the roll forming methods of the present invention.

According to another roll forming method of the present invention, one or more strips of sacrificial metal are wrapped around the exposed surface(s) of the ferrous metal bar or tube, and are rolled (formed) around the bar or tube by a series of rollers.

One die casting method of making a galvanically protected bar dowel pin according to the present invention begins with placement of the bar or tube inside a mold cavity. The mold cavity has internal dimension(s) larger than the external dimension(s) of the bar or tube. Molten zinc, magnesium, or aluminum, or one of their respective alloys, are injected into the cavity under pressure, and the defined void between the mold and the exterior surfaces of the bar or tube is filled with molten metal. The molten metal is then allowed to cool to solidify the metal so that the metal completely encases the external surfaces of the dowel bar or tube.

In the case of a tubular steel dowel pin, the external surfaces of the tube are first coated according to the above die casting method used for bars, and then is transferred to a different mold cavity, the interior of which is designed to closely match the external dimension(s) of the metal coated product. The inside dimension(s) of the second mold are defined by two removable inserts that are sized to leave a gap between the inserts and the internal surface of the tubular dowel pin. The two removable inserts are also sized with a sufficient "draft angle" to allow the inserts to be withdrawn outward from the center of the metal coated product. As before, molten metal is injected into the gap and the metal is allowed to solidify to completely encase the internal surfaces of the tubular dowel pin. Then, the inserts are removed from within the dowel pin by withdrawing the inserts outward. It will be appreciated that both the mold processes used for coating tubular dowel pins on both the inside and outside exposed surfaces could be performed simultaneously in the same mold cavity. Also, an alternate die casting method for bars or tubes involves gravity fed, rather than injection fed, molds.

According to a coating method of the present invention, the steel, carbon steel, or other ferrous metal dowel pin is flame sprayed or plasma sprayed with an adherent layer of sacrificial metal. The sprayed sacrificial metal forms an outer protective shield. This shield also serves as the anode in the galvanic process, thereby protecting the dowel pin.

In another coating method of the present invention, a steel, carbon steel, or other ferrous bar or tube is dipped into a galvanic material. The galvanic material of both coating methods is formulated to contain a high level of galvanic metal in powder form, together with a low percentage of organic binder in solution or suspension form.

Reinforcement dowel pins of the present invention provide corrosion resistance, while maintaining the integrity and strength of the dowel pin. The methods of manufacture of the dowel pins are straightforward. Also, the dowel pins of the present invention are installed in concrete using conventional methods. Further, the dowel pins of the present invention may be made hollow having a filler (such as foam or cement) in the center thereof, thereby reducing costs when compared to solid dowel pins while maintaining the structural integrity for use required when used in concrete or cement. In addition, the dowel pins of the present invention may easily be formed into a shape having an elipitcal cross-section—a desired shape for strength of the dowel pin. Thus, the reinforcement dowel pins according to the present invention provide galvanic non-corrosive protection or other environmental protection, and are reasonable in materials costs, costs of manufacture, and installation costs.

DETAILED DESCRIPTION

Figure 1:
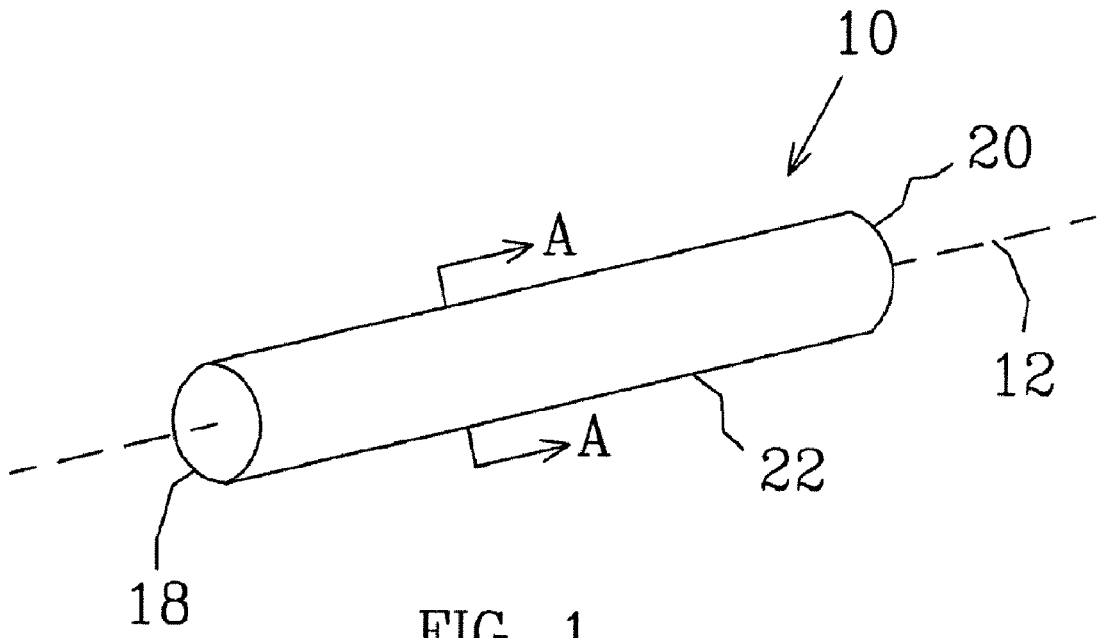
FIG. 1 shows a perspective view of one embodiment of a reinforcement dowel according to the present invention.

Referring now to FIG. 1, there is shown a perspective view of one embodiment of a reinforcement dowel according to the present invention. In this embodiment, dowel pin 10 comprises a cylindrically shaped bar covered by a sacrificial metal, as is described in further detail in association with FIG. 2. Dowel pin 10 has a longitudinal axis 12.

Figure 2:
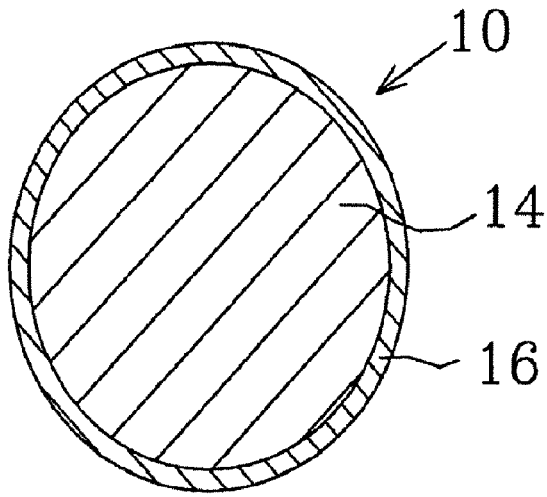
FIG. 2 shows a cross-sectional view of the reinforcement dowel of FIG. 1 at line A-A.

FIG. 2 shows a cross-sectional view of the reinforcement dowel of FIG. 1 at line A-A. Dowel pin 10 comprises bar 14 and sacrificial metal coating 16. In this embodiment, metal coating 16 covers all exposed surfaces of bar 14. Referring to FIG. 1, metal coating 16 covers first and second ends 18 and 20, respectively, and also covers longitudinal surface 22 about longitudinal axis 12. Bar 14 is comprised of steel, carbon steel, other ferrous metal, or other corrosive structural material. Metal coating 16 comprises zinc, zinc alloy, magnesium, magnesium alloy, aluminum, or aluminum alloy. An example of a zinc alloy is one comprising 85% zinc and 15% other metals. Examples of magnesium alloys include AZ-31B or HK-31A. An example of an aluminum alloy is 1145 pr 3003.

Figure 3:
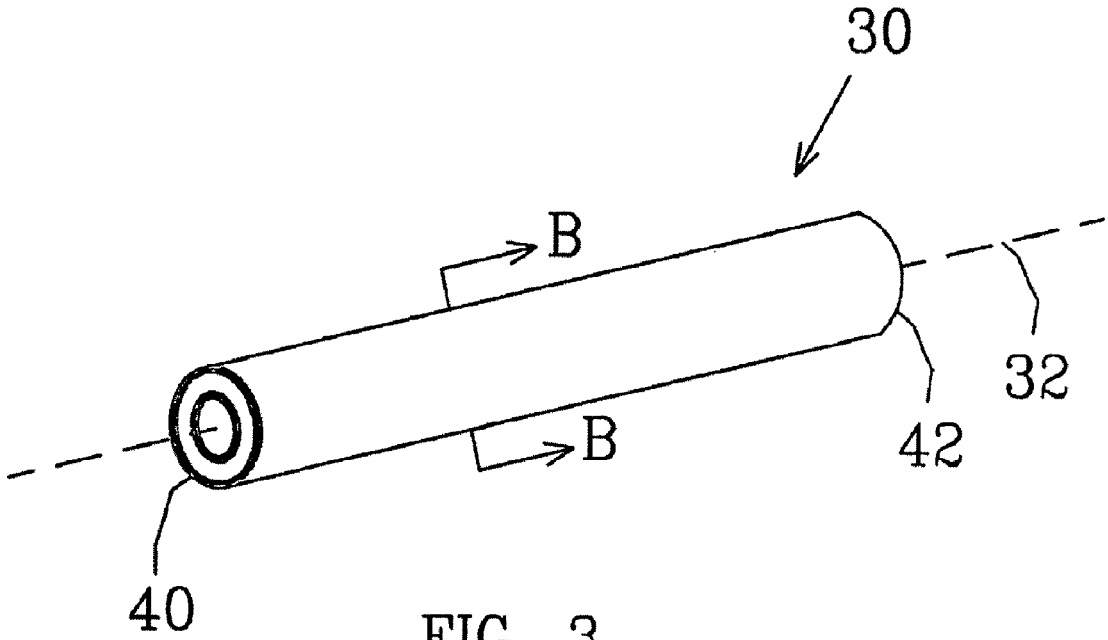
FIG. 3 shows a perspective view of another embodiment of a reinforcement dowel according to the present invention.
Figure 4:
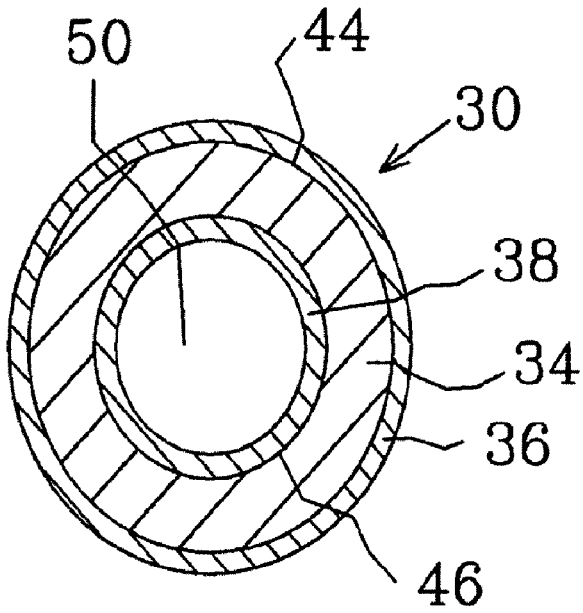
FIG. 4 shows a cross-sectional view of the reinforcement dowel of FIG. 3 at line B-B.

Referring now to FIG. 3 and FIG. 4, there are shown a perspective view and a cross-sectional view, respectively, of another embodiment of a reinforcement dowel according to the present invention. In this embodiment, dowel pin 30 has first and second ends 40 and 42, respectively, with longitudinal axis 32 extending there between. Tube 34 is cylindrically shaped in this embodiment and has outer diameter 44 and inner diameter 46 about longitudinal axis 32. First metal coating 36 covers the exposed surface defined by outer diameter 44 about longitudinal axis 32 for the entire length of tube 34. Second metal coating 38 covers the exposed surface defined by inner diameter 46 about longitudinal axis 32 for the entire length of tube 34.

Reinforcement dowel pins 10 and 30 are made according to one or more the processes set forth therein. Those processes are generally referred to herein as roll forming, die casting, flame spraying, plasma spraying, dipping or coating, sinking, drawing, welding, or lock seaming. Each of these methods is discussed herein in association with dowel pin 10 of FIG. 1 and FIG. 2, and in association with dowel pin 30 of FIG. 3 and FIG. 4.

Dowel pin 10 may be created using sinking or drawing processes. According to the sinking process, metal coating 16 is provided in the form of a tube having a diameter larger than the diameter of bar 14. The tube of metal coating 16 is sized to allow bar 14 to placed within the interior thereof, with metal coating 16 in contact with or very near contact with bar 14 when so placed. After bar 14 is placed inside the tube of metal coating 16, the tube of metal coating 16 is drawn down onto the exterior exposed surface of bar 14 along longitudinal axis 12 to cause the tube, and hence, metal coating 16, to be in intimate contact with the exterior exposed surface of bar 14. This drawing down of the tube of metal coating 16 is accomplished by the sink-draw process whereby the tube is drawn through a die having a diameter smaller than the diameter of the tube of metal coating 16 to decrease the diameter of the tube of metal coating 16.

According to this sinking method, the exterior surface of bar 14 along longitudinal axis 12 is covered with a single layer metal coating 16, but ends 18 and 20 remain exposed. Ends 18 and 20 of dowel pin 20 may be covered with a sacrificial metal coating using methods, such as die casting, dipping, or flame spraying, as is explained in greater detail herein.

The above described sinking method may also be used to form first metal coating 36 of dowel pin 30 shown in FIG. 3 and FIG. 4. Second metal coating 38 of dowel pin 30 may be formed according to the drawing process of the present invention. According to the drawing method, second metal coating 38 is provided in the form of a tube having a diameter smaller than the interior diameter of tube 34. This tube of second metal coating 38 is placed inside tube 34 and expanded outward onto the interior surface of tube 34 along longitudinal axis 32 to be in intimate contact with tube 34. This expansion of the tube of second metal coating 38 is accomplished by the sink-draw process whereby the tube is drawn through a die having a diameter larger than the diameter of the tube of second metal coating 38 to increase the diameter of the tube of metal coating 38.

It will be appreciated by those of skill in the art that any tube of zinc, zinc alloy, magnesium, magnesium alloy, aluminum, or aluminum alloy provided for any method of making a dowel pin according to the present invention can be made by any method well known in the art. These methods include, but are not limited to, extrusion and roll forming, with any seams welded together or lock seamed.

According to other methods of the present invention, sacrificial metal is lock seamed or welded to be in intimate contact with the bar or tube of steel, carbon steel, or other ferrous metal. Referring to FIG. 1 and FIG. 2, metal coating 16 is provided in the form of one or more strips, each of the one or more strips of a length proximally equivalent to the diameter of bar 14. Each strip is then welded or lock seamed onto the longitudinal exposed surface of bar 14. These same processes can be used to cause second metal coating 38 and/or first metal coating 36 to be in intimate contact with tube 34 to form dowel pin 30 of FIG. 3 and FIG. 4.

According to one die casting method of making dowel pin 10, dowel pin 10 is placed in a mold cavity. Such mold cavity has internal dimension(s) larger than the diameter (dimension (s)) of bar 14. Molten sacrificial metal is then allowed to solidify to completely encase bar 14 with a single layer metal coating 16. The encasement includes first and second ends 18 and exterior surface 22 as shown in FIG. 1.

According to a die casting method of making dowel pin 30, in one embodiment, a mold cavity and two removable inserts are provided. The mold cavity has internal dimension(s) larger than the external dimension(s) of tube 34. The two removable inserts are sized to be inserted inside tube 34 from first and second ends 40 and 42, to meet within the center of tube 34 at some point along longitudinal axis 32, and with a sufficient "draft angle" to allow the inserts to be withdrawn outward from first and second ends 40 and 42 after the molten metal is allowed to solidify as described herein. Continuing with the process, the two removable inserts are placed inside tube 34, and the combination of tube 34 with the removable inserts are placed inside the mold cavity. Molten sacrificial metal is injected into the mold cavity and allowed to solidify to completely encase the exposed surfaces of dowel pin 30. In this manner, first and second metal coatings 36 and 38 result and, if the mold cavity is longer than the length of tube 34, first and second ends 40 and 42 are also coated with the sacrificial metal.

In another die casting method for producing dowel pin 30, two mold cavities may be used. The first mold cavity is intended to coat the outside of tube 34. The second mold cavity is used to coat the inside of tube 34.

In yet another alternate die casting method for dowel pin 30, no removable inserts are required. Instead, the mold cavity having internal dimension(s) larger than the external dimension(s) of tube 34 is provided, and tube 34 inserted therein. Molten sacrificial metal is injected into the mold cavity and allowed to solidify. This solidification results in first metal coating 36 as shown in FIG. 4, and a second metal coating that fills the entire space within inner diameter of tube 34 along longitudinal axis 32. As discussed above in association with the first thermal bonding method used for dowel pin 30, if the mold cavity is longer than the length of tube 34, first and second ends 40 and 42 are also covered by the sacrificial metal under this process.

Other die casting methods may be used to produce dowel pin 10 of FIG. 1 and FIG. 2 and dowel pin 30 of FIG. 3 and FIG. 4. In these methods, the mold cavity(ies) are gravity fed with molten sacrificial metal rather than being injected with molten metal. In other respects, these die casting methods are substantially the same as the injection die casting methods described above.

Dowel pin 30 may also be formed by roll forming process. Specifically, a strip of base material used to form tube 34 is clad with a strip of first metal coating 36 by roll bonding. Roll bonding may also be used to clad the strip that will form tube 34 with a strip of second metal coating 38 on the opposite side as is clad the strip that forms first metal coating 36. Then, the clad strip is formed and welded into the shape of dowel pin 30. Alternately, the clad strip is formed and lock seamed into the shape of dowel pin 30.

Dowel pin 10 of FIG. 1 and FIG. 2 and dowel pin 30 of FIG. 3 and FIG. 4 may be made by another roll forming method. As to dowel pin 10, one or more strips of ferrous metal used to form metal coating 16 are wrapped around bar 14 and the combination of bar 14 with the strip(s) of metal coating 16 are worked (formed) through a series of rollers. In this manner, metal coating 16 is caused to be in intimate contact with bar 14. This second roll forming method can also be used to cause first metal coating 36 and/or second metal coating 38 to be in intimate contact with tube 34 to produce dowel pin 30 of FIG. 3 and FIG. 4.

According to another method of the present invention, the bar or tube is coated with an adherent layer of sacrificial metal by one of the processes known as flame spraying or plasma spraying. This flamed-sprayed or plasma-sprayed layer of metal forms an outer protective shield protecting the base or tube from corrosion. When a galvanic metal is used, the metal serves as an anode in a galvanic process to protect the bar or tube.

Another coating method for making the reinforcement dowel pin of the present invention involves dipping. Specifically, exposed surfaces of the bar or tube are dipped into a galvanic material containing the protective metal. When a galvanic metal such as zinc, zinc alloy, magnesium, magnesium alloy, aluminum, or aluminum alloy, is used, the galvanic material is formulated to contain a high level of such galvanic metal in powder form, together with, in many instances, a low percentage of organic binder or other bonding agent in solution or suspension form. Such formulations ensure that the metal particles remain substantially in contact with each other and the bar or tube when dipped and when the galvanic material has dried or cured. When such a material is dried onto the surface of the bar or tube, a coating/film results. The coating/film contains particles of the metal bonded to each other and the bar or tube sufficient to remain adhered, yet remain in direct contact with each other and the bar or tube such that sufficient electrical conductivity is present to ensure the dowel pin is protected by the galvanic process.

First end 18 and second end 20 of dowel pin 10, and first end 40 and second end 42 of dowel pin 30 are not necessarily covered according to the methods described above. However, first and second ends 18 and 20 of dowel pin 10, and first end 40 and second end 42 of dowel pin 30 may be covered using methods known in the art. Specifically, other methods well known in the art, such as the use of end caps, or filling tubular ends with an inert material such as cement or foam, may be used to place a sacrificial metal coating or other environmentally protective material on first and second ends 18 and 20 of dowel pin 10 and on first and second ends 40 and 42 of dowel pin 30. It is also conceived that the flame spraying, plasma spraying, or dipping (coating) methods described herein for covering the exposed longitudinal surfaces may be used to cover the ends of the tube or bow without regard to the specific method used to coat the exposed longitudinal surface(s).

It is not required that the sacrificial metal coating applied at first and second ends 40 and 42 of dowel pin 30 leave open aperture 50 (See FIG. 4), but, instead, may cover aperture 50. It will also be appreciated that, if first and second ends 40 and 42 of dowel pin 30 include a coating of sacrificial metal, it is not required that dowel pin 30 include second metal coating 38 to maintain the corrosion resistant benefits of the present invention, because the interior surface of tube 34 defined by inner diameter 46 along longitudinal axis 32 is not exposed to moisture and other corrosion causing factors when first and second ends 40 and 42 are coated.

Corrosion generally occurs along the longitudinal axis of the dowel pins. Thus, it is possible that only the longitudinal exposed surfaces are environmentally protected according to the present invention. The ends may remain exposed or be covered by another process that does not result in the same type of environmental protection provided against corrosion. The ends may be painted with a non-galvanic paint or have end caps placed thereon. For tubular dowel pins, the ends may be stuffed with a filler, such as foam or cement, In fact, the interior of a tubular dowel pin according to the present invention may include a filler throughout the interior thereof. Further, tubular dowel pins having a metal coating on the exterior longitudinal exposed surfaces, and not the interior longitudinal surfaces, is contemplated to be within the scope of the invention.

It is desired for the metal coatings of the dowel pins of the present invention to be of a thickness that allows the coating to serve as a sacrificial anode to resist corrosion over very long periods of time, and to resist the wearing away of the coating that may be caused by installation of the dowel pin and/or caused by abrasion arising from the expansion and contraction of the concrete into which the dowel pin is laid. This thickness, referred to herein as "heavy gauge", is generally greater than the thickness of a coating applied by a single dipping or galvanizing process, and is generally is at least about 0.020 inches. The desired thickness of the metal coating is dependent upon the environmental conditions into which the dowel pins are to be introduced. The minimum thickness is likely to be dictated by such conditions, including temperature, moisture, salt levels, etc., and also by the level of care, or lack thereof, taken in handling and installing the dowel pins. As to the latter, if the metal coating is too thin, the coating may be scratched off during handling or installation to expose a portion of the underlying steel or carbon steel. Such exposure defeats the intended effect of corrosion avoidance.

There is no restriction as to the maximum thickness, except that a very thick metal coating may be costly in materials and manufacturing costs. It is generally desired to keep such costs in check. Although the range of thickness is variable, a thickness from about 0.020 inches to about 0.080 inches comprises an embodiment of the dowel pin of the prevent invention. One prototype produced according to the present invention had a thickness of about 0.050 inches.

It will be appreciated by those of skill in the art that the reinforcement dowel pins of the present invention are produced with methods known generally in the art of metal forming and processing, and, therefore, do not require additional equipment for the manufacturer. Thus, a manufacturer does not incur extraordinary capital expenditures or labor costs to produce the reinforcement dowel pins according to the methods of the present invention.

It will also be appreciated that the dowel pins of the present invention are installed in a conventional manner between adjacent blocks of concrete. No additional equipment is required for installation, nor are any additional installation steps required. Thus, the reinforcement dowel pins of the present invention are inexpensive to install.

It will be further appreciated that the presence of the sacrificial anode provides a mechanism for thwarting corrosion of the bar or tube to which the sacrificial anode is adhered. Because the sacrificial metal is applied in heavy gauge, it serves in this anti-corrosion capacity far longer than would the application of a thin coating of metal or epoxy as could be applied using a galvanizing process. It will also be appreciated that the heavy gauge of sacrificial anode is more resistant to wearing the mechanical stresses caused by welding of the dowel pins into support structures during road construction and the abrasion resulting from slab movement after construction than are dowel pins coated with an epoxy. Also, the structural strength of the dowel pin is not compromised as with glass reinforced dowel pins. Further, the cost of a reinforced dowel according to the present invention is significantly less than the cost of a stainless steel dowel pin.

It will be still further appreciated that the dowel pins according to the present invention do not need to be cylindrical in shape, although one common shape of prior art dowel pins has been cylindrical. Thus, the terms "bar" and "tube" as used herein with respect to the present invention, and in the claims, are not limited to dowel pins having a cylindrical cross-section, but instead may also apply to dowel pins having rectangular, square, oval, eliptical, polygon, or irregular cross-section. Further, the dowel pin of the present invention is not required to have a constant cross-section along the length, to be straight along its length, or to have a regular shape to be within the scope of the invention.

It will be yet further appreciated that the dowel pins of the present invention may be specifically formed in an elliptical shape in cross-section. The elliptical shape provides greater strength in the application in concrete or cement when compared to many other cross-sectional shapes. Also, the dowel pins of the present invention may be made with a hollow center, regardless of its cross-sectional shape as a "tube." Then, the hollow center is filled with a filler such as foam or cement. Such a filled tubular dowel pin is less expensive in materials and costs, but maintains its structural integrity when installed.

The present invention can be further modified within the scope and spirit of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

We claim:

1. A dowel comprising:

a solid bar formed of a ferrous metal, the bar having a longitudinal axis, a first end configured to be located in a first concrete section, a second end spaced from the first end, the second end being configured to be located in a second concrete section positioned adjacent the first concrete section, the bar having a substantially uniform thickness from the first end to the second end, and an outer surface extending from the first end to the second end, and a single layer of heavy gauge galvanic material having a substantially uniform thickness of at least 0.02 inches drawn down onto, reduced in diameter, and in intimate contact with the outer surface from the first end to the second end about the longitudinal axis of the bar.

2. The dowel of claim 1, wherein the ferrous metal includes at least one of steel and carbon steel.

3. The dowel of claim 2, wherein the galvanic material is formed of at least one zinc, zinc alloy, magnesium, magnesium alloy, aluminum, and aluminum alloy.

4. The dowel of claim 3, wherein the galvanic material has a thickness of at least 0.05 inches.

5. The dowel of claim 4, wherein the galvanic material is applied to the outer surface by a single process.

6. The dowel of claim 5, wherein the single process is a sinking process.

7. The dowel of claim 6, wherein the galvanic material is applied to the first and second ends of the bar by a second process.

8. The dowel of claim 1, wherein the bar is substantially elliptically shaped.

9. A dowel comprising:

a reinforcing member installable between adjacent blocks of concrete to form a joint, the member including a ferrous metal and having a longitudinal axis, a first end, a second end spaced from the first end along the longitudinal axis, a substantially uniform thickness from the first end to the second end, at least one surface extending from the first end to the second end along the longitudinal axis, and a single layer of heavy gauge galvanic material of sufficient thickness of at least 0.02 inches to withstand corrosive and abrasive elements, the galvanic material being applied substantially uniformly to and in intimate contact with the at least one surface in the sufficient thickness in a single layer.

10. The dowel of claim 9, wherein the reinforcing member includes an outer surface exposable to corrosive and abrasive elements, and a heavy gauge galvanic material applied to the outer surface.

11. The dowel of claim 10, wherein the heavy gauge galvanic material has a thickness of at least 0.50 inches.

12. The dowel of claim 9, wherein the galvanic material is applied by a sink-draw process.

13. The dowel of claim 9, wherein the bar is elliptically shaped.

14. The dowel of claim 9, wherein the galvanic material is applied by a die casting process.

* * * * *